United States Patent [19]

Shyu et al.

[11] Patent Number: 5,040,117

[45] Date of Patent: Aug. 13, 1991

[54] AUTOMATICALLY ADJUSTING THE EMISSIONS FROM AN IDLING ENGINE

[75] Inventors: Jia-Ming Shyu; Min-Lee Chen; James H. Wang, all of Hsin Chu Shien, Taiwan

[73] Assignee: Industrial Technology Research Institute, Hsin Chu Hsien, Taiwan

[21] Appl. No.: 413,202

[22] Filed: Sep. 27, 1989

[51] Int. Cl.[5] ..... F02D 41/26; F02D 33/00

[52] U.S. Cl. ..... 364/424.03; 73/117.2; 123/339; 364/431.06

[58] Field of Search ..... 364/424.02, 424.03, 364/424.04, 431.04, 431.06; 73/117.2, 23.31, 23.32; 123/339

[56] References Cited

U.S. PATENT DOCUMENTS 4,291,382 9/1981 Full et al. ..... 364/431.04
4,328,546 5/1982 Kreft et al. ..... 73/23.31
4,372,155 2/1983 Butler et al. ..... 73/23.32
4,471,738 9/1984 Smojver ..... 73/23.32
4,757,463 7/1988 Ballou et al. ..... 364/551.01
4,926,330 5/1990 Abe et al. ..... 364/424.03

*Primary Examiner*—Felix D. Gruber
*Attorney, Agent, or Firm*—Cushman, Darby & Cushman

[57] ABSTRACT

A device for sensing the emissions from an idling engine and automatically adjusting the engine so as to minimize pollutants in the exhaust. The device measures the composition of gas emitted and the engine speed at idle and compares the measured values to predetermined values. When differences occur between the measured and predetermined values, an actuator is signaled which adjusts the position of an air-regulating screw and an idling screw in the carburetor until the measured values are acceptable.

2 Claims, 2 Drawing Sheets

START
SENSORS SET-UP
INPUT DATA FILENAME
AUTO/MANUAL ADJUSTING
SAMPLING CO,HC,RPM
BCO = CO
BHC = HC
BRPH = RPM
BDRPM = RPM
CALL ADJUST RPM
(CO COSTD) OR (CO<2.5)
N
Y
CALL ADJUSTAFR
CO>(OSTD OR(ABS<DRPM) >DRPMH)
N
Y
CO> COSTD
Y
AIR SCREW TURN LEFT
N
CO<COSTDL
Y
AIR SCREW TURN RIGHT
N
SAMPLING CO, HC RPM,DEL TRPM
CALL ADJUST RPM
SAMPLING CO,HC,RPM
AUTO FLAG=1
N
CALL OPTIMAL
EXIT

AUTOMATICALLY ADJUSTING THE EMISSIONS FROM AN IDLING ENGINE

BACKGROUND OF THE INVENTION

Since vehicles have widely been used as a transportation means, air pollution has become a serious problem. Almost 70% of all motorcycles use a two-stroke engine, which forms a major pollution source. Although all new motorcycles have been inspected and adjusted before leaving the factory to comply with the exhaust emission regulations, most used motorcycles have a higher pollution level than standards allow as a result of maintenance and operation negligence. Moreover, besides polluted air quality, engine malfunction and damage to parts also exist. It seems an adverse cycle in terms of air pollution.

SUMMARY OF THE INVENTION

In view of the aforesaid problem, the inventor has provided a device, whereby the exhaust composition of HC and CO in an idle condition of a vehicle can be measured and adjusted automatically according to the optimal engine performance, i.e., the carburetor of the engine can be adjusted automatically so as to minimize the exhaust emission level in the idle condition.

Currently, the method of optimizing engine emission at idling speed is to adjust the air screw and idling screw of carburetor. The function of the air screw is to adjust the low load air-to-fuel ratio, while the idling screw to adjust the engine idle speed. Only when those screws are adjusted correctly can the engine be operated in the idle condition with minimal emission level and optimal performance.

Conventionally, the engine idle adjustment is performed by an experienced person such as a mechanic, who is able to make a judgement from measuring exhaust emissions and engine performance. As a result, the adjusting results are different from engine to engine because of personal experiences and habits. Furthermore, the engine adjustment cannot be done repeatedly within a given accuracy, and the adjusting service can not be done by the average, unskilled people. Because the adjusted result can not be described by tangible and quantitative means, it is not widely acceptable.

DETAILED DESCRIPTION

Figure 1:
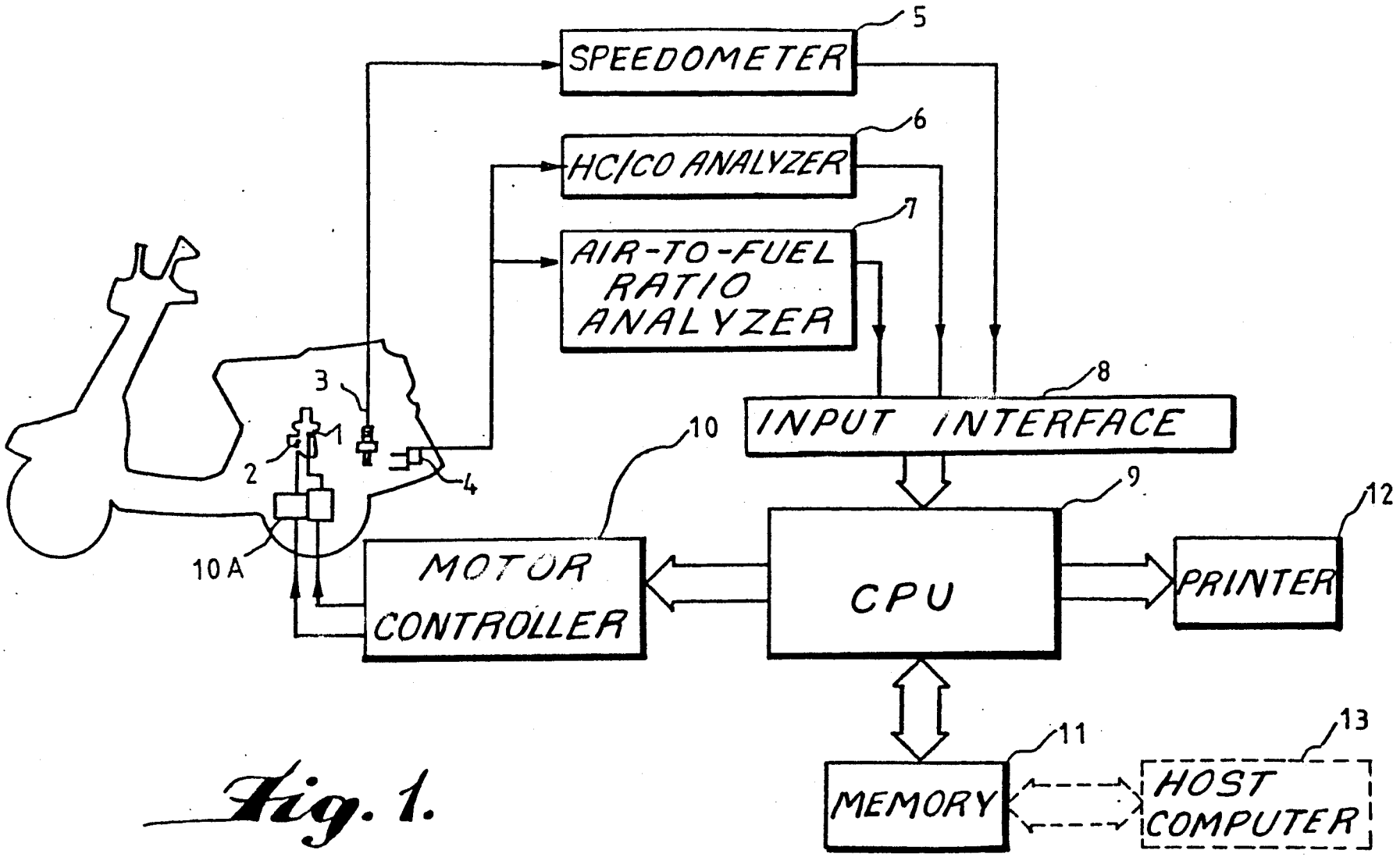
FIG. 1 is a system diagram of an embodiment of the automatic adjusting device of an idle emission for automobiles and motorcycles according to the present invention.

FIG. 1 illustrates the system diagram of the automatic adjusting device of the present invention, which comprises sampling pipe 4 for sampling exhaust gas, an ignition induced tachometer 5 which is clamped to the ignition cable 3, a HC/CO analyzer 6 for analyzing the exhaust composition, and an air-to-fuel ratio analyzer 7. The acquired data of engine speed, HC/CO emission level, and air/fuel value are then to be fed, through an input interface 8, to a CPU 9. The memory 11 and the printer 12 are also connected with CPU 9 which may be further linked to a host computer 13. The CPU 9 delivers commands to a motor controller 10 and actuators 10A so as to adjust the air screw 2 and the idling screw 1.

In operation, the vehicle should be started first to warm up the engine; the sampling pipe 4 is then connected with the outlet of the exhaust pipe to extract part of the exhaust gas to the HC/CO analyzer 6 and air/fuel analyzer 7. Also, the inductive tachometer 5 is clamped to the ignition cable 3, and the actuators 10A clamp to the air screw 2 and the idling screw 1 of the carburetor. Then, the device operates automatically.

Figure 2:
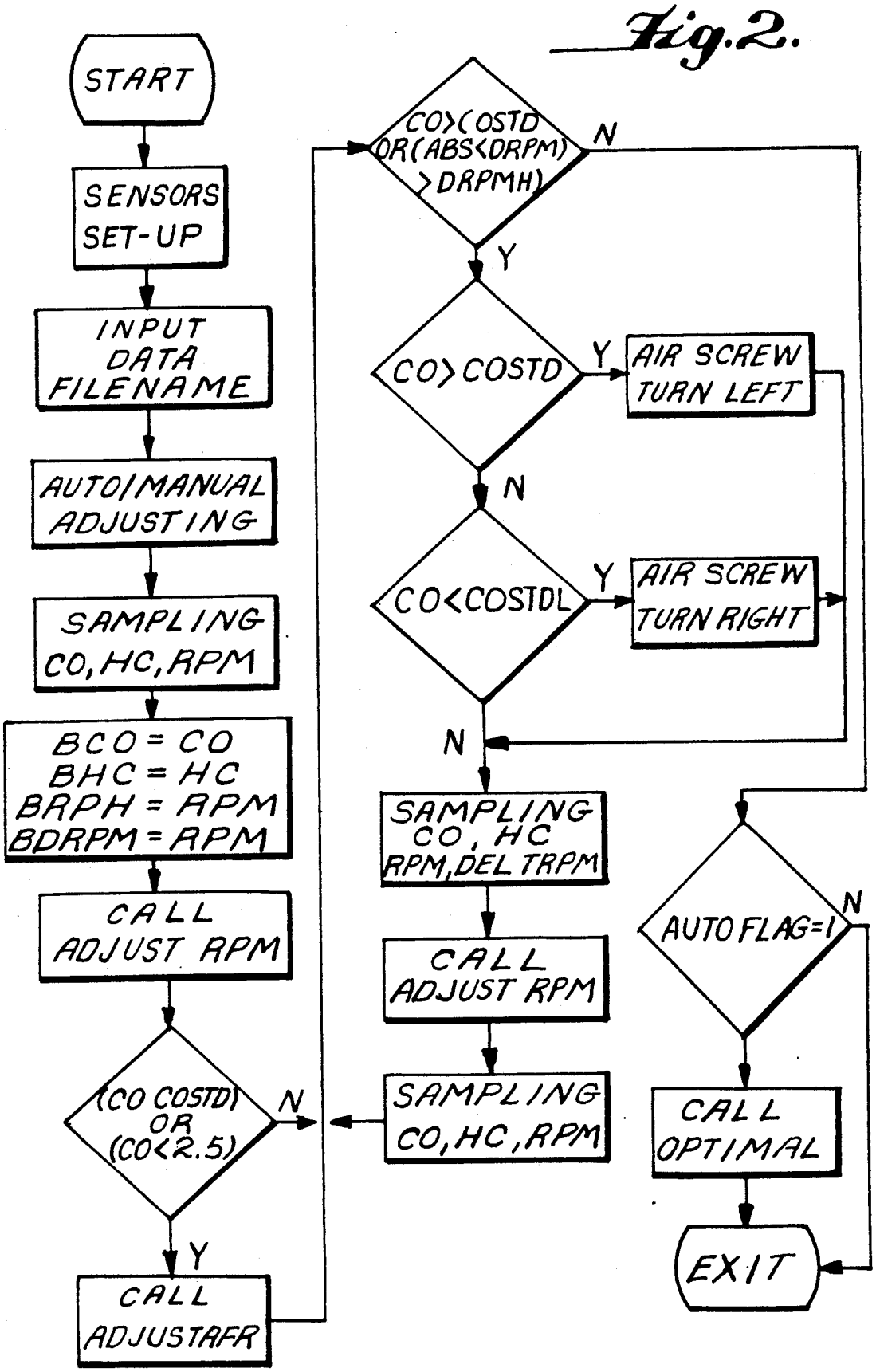
FIG. 2 is a flow chart of function of the automatic adjusting device of the idle emission for automobiles and motorcycles according to the present invention.

The speed of the engine is calculated by referring to the cycle voltage induced by ignition; the per exhaust HC/CO compositions are measured by a non-dispersive infrared method. The air-to-fuel ratio is determined by measuring the oxygen pressure in the exhaust gas; all the aforesaid data are then to be transmitted, via input interface, 8 to the CPU 9 for further calculation, analysis, comparison and logic judgement. In the memory 11, there are stored data of the normal idle speed, exhausted emission level, and preset positions of the air screw and idling screw for various gear models of automobiles and motorcycles. As shown in FIG. 2, comparison will be conducted, after a vehicle model is put into the device, between the criteria stored in memory and the data measured from both the exhaust pipe and the ignition unit so as to determine whether the idling speed of the engine is normal or not. If the idling speed of the engine is abnormal, CPU 9 will, in accordance with the logic of the software program, send out an instruction to the motor controller 10 and the actuator 10A to drive the air screw 2 and the idling screw 1 to make a proper adjustment until the engine reaches the best idling condition. In other words, the idle adjustment is to be done within a closed and automatic control system, which consists of measurement, analysis and adjustment; each of the operational steps can be recorded so as to obtain the best adjustment result. A vehicle being measured and adjusted with the device according to the present invention will have a record data stored in the memory 11; the data record may also be transfered to other host computers for other purposes, such as statistics or trace control.

Another feature of the present invention is that it can be applied to engine diagnostics in the measurement and test of performance. In that case, the hardware part may include the original micro-computer or micro-processor with additional sensors of temperature, pressure, voltage and current so as to measure the performance parameters of the engine, such as temperature of lubrication oil, cooling water, spark plug, compression pressure, intake vacuum, ignition voltage, battery voltage, the cranking current etc. In the software part, the memory may be stored with the criteria of the normal functions of various engine models of vehicles, and the data of trouble-shooting steps and inspection items. During operation, the screen may display the various function data of the engine, and simultaneously display the parts to be tested or replaced if any function value exceeds the normal tolerance. The trouble-shooting comments may be shown on the display screen or printed with a printer for repairman's reference so as to speed up the repair work.

The present invention can be used to replace manual adjustment work to the engine in accordance with experiences, i.e., the adjustment may be done by means of sensors, micro-computer, and motor controller, which are operated on a systematic and integral basis. The adjustment can be done in a short time with less man power and without requiring an experienced repairman, and also can be done with high precision and reliability. The present invention can be used in any vehicle equiped with an engine that includes a carburetor, and also can be used by vehicle inspection units of highway supervision authorities, or the general repair shop.

We claim:

1. A device for minimizing emission pollutants from an idling engine, comprising:

an air-regulating screw, for regulating an air-to-fuel ratio of a carburetor of said engine;

an idling screw, for adjusting the engine idle speed;

actuators, for adjusting the respective positions the air-regulating screw and idling screw in response to command signals;

an exhaust gas sampling pipe, for sampling an exhaust gas from the engine;

means for measuring the idling speed and generating a first signal indicative thereof;

means for analyzing the composition of HC and CO in the sampling pipe and generating a second signal indicative thereof;

means for analyzing the air-to-fuel ratio of the exhaust gas in the sampling pipe and generating a third signal indicative thereof;

means for inputting the first, second, and third signals to a central processing unit, the central processing unit having means for storing a preset position of the air-regulating screw and idling screw;

means for reading the first signal and comparing the first signal to a first predetermined value;

means for generating the actuator command signal to position the idling screw at the preset condition if the first signal does not equal the first predetermined value;

means for reading the second and third signals and measuring the density of HC and CO therefrom;

means for comparing the measured density to a predetermined density; and means for generating the actuator command signal to adjust the air-regulating screw if the measured density does not equal the predetermined density.

2. A device for adjusting emissions as in claim 1, wherein the central processing unit further includes:

means for comparing a plurality of engine temperatures, respectively to a plurality of predetermined normal temperature;

means for comparing a plurality of engine pressures, respectively to a plurality of predetermined normal pressures;

means for comparing a plurality of engine voltages, respectively to a plurality of predetermined normal voltages;

means for comparing a plurality of engine currents, respectively to a plurality of predetermined normal currents.

* * * * *